US006419249B1

(12) United States Patent
Chen

(10) Patent No.: US 6,419,249 B1
(45) Date of Patent: Jul. 16, 2002

(54) ROLLER BOARD WITH A PIVOTING ROLLER UNIT WHICH IS ADAPTED TO PROVIDE ENHANCED STABILITY DURING TURNING MOVEMENT

(76) Inventor: Sheng-Huan Chen, 11F, No. 212, Chung-Shan 1st Rd., Lu-Chou City, Taipei Hsien (TW)

( * ) Notice: Subject to any disclaimer, the term of this patent is extended or adjusted under 35 U.S.C. 154(b) by 0 days.

(21) Appl. No.: 09/909,495

(22) Filed: Jul. 20, 2001

(51) Int. Cl.[7] ..... A63C 17/04

(52) U.S. Cl. ..... 280/87.042; 280/11.27; 16/35 R

(58) Field of Search ..... 280/87.041, 87.042, 280/11.27, 11.28, 11.19, 11.221, 11.233, 11.25; 16/35 R, 35 D

(56) References Cited

U.S. PATENT DOCUMENTS 4,181,316 A * 1/1980 Brand et al. ..... 280/11.207
4,246,677 A * 1/1981 Downing et al. ..... 16/35 R
4,280,246 A * 7/1981 Christensen ..... 16/35 D
4,336,629 A * 6/1982 Jarvis, Jr. et al. ..... 16/35 R
4,553,767 A * 11/1985 Robjent et al. ..... 188/82.3
4,595,209 A * 6/1986 Tsai ..... 188/74
5,833,252 A 11/1998 Strand ..... 280/87.042
5,975,546 A * 11/1999 Strand ..... 16/35 D
5,979,916 A * 11/1999 Gatel et al. ..... 280/11.224
6,315,312 B1 * 11/2001 Reyes et al. ..... 280/11.27

* cited by examiner

*Primary Examiner*—Avraham Lerner
*Assistant Examiner*—Bridget Avery
(74) *Attorney, Agent, or Firm*—Akin, Gump, Strauss, Hauer & Feld, L.L.P.

(57) ABSTRACT

A roller board includes a base plate with a cam retaining bore and an accommodating chamber. A roller unit includes a caster mounted rotatably to the base plate underneath the retaining bore, and a roller journalled to the caster. A cam, in the form of a rotatable shaft, is connected to the caster, extends into the chamber via the retaining bore in the base plate, and has a top end which defines an annular cam face with a pair of diametrically opposite lowermost points and a pair of diametrically opposite uppermost points between the lowermost points. A cam follower is disposed within the chamber, and includes an urging spring that has a first end fixed to the base plate and a second end disposed above and abutting against the cam face for urging the cam in an axial direction relative to the cam.

2 Claims, 5 Drawing Sheets

ROLLER BOARD WITH A PIVOTING ROLLER UNIT WHICH IS ADAPTED TO PROVIDE ENHANCED STABILITY DURING TURNING MOVEMENT

BACKGROUND OF THE INVENTION

1. Field of the Invention

This invention relates to a roller board, more particularly to a roller board with a pivoting roller unit which is adapted to provide enhanced stability during turning movement.

2. Description of the Related Art

Referring to FIG. 1, a conventional roller board 1 is shown to include a horizontal rigid platform 10, first and second longitudinally spaced-apart base plates 21 disposed beneath and fixed to the rigid platform 10, first and second longitudinally spaced-apart wheel assemblies 30, 40 mounted on the platform 10 adjacent to the base plates 21 respectively, and first and second longitudinally spaced-apart roller units 2 mounted on the base plates 21 respectively.

With reference to FIG. 2, each of the base plates 21 has a cam retaining bore 211 and an accommodating chamber 210 which surrounds the cam retaining bore 211 and which spatially communicates with the cam retaining bore 211. Each of the roller units 2 includes a caster 22 mounted rotatably to the base plate 21 underneath the retaining bore 211, a roller 221 journalled to the caster 22, and a cam mechanism. The cam mechanism includes a cam 234 in the form of a rotatable shaft that is connected to the caster 22, and extends into the chamber 210 via the retaining bore 211 in the base plate 21, and that has an outer circumferential wall which defines a cam face 235 with a pair of diametrically opposite horizontal flat sides 237 and a pair of diametrically opposite curved sides 236 between the flat sides 237. A cam follower is disposed within the chamber 210 of the base plate 21, and includes an urging spring 24 that has a first end fixed to the base plate 21 and a second end which abuts against a selected one of the flat sides 237 for urging the cam 234 in a radial direction relative to the cam 234. Under this condition, the cam 234 is rotatable along with the caster 22 between a first position, in which, the second end of the urging spring 24 abuts against the cam face 235 at one of the flat sides 237 for urging the caster 22 to be maintained in a travelling direction parallel to a longitudinal axis of the base plate 21, as best shown in FIG. 3, and a second position, in which the second end of the urging spring 24 abuts against the cam face 235 at one of the curved sides 236 for urging the caster 22 to be maintained in a transverse direction relative to the longitudinal axis of the base plate 21, as best shown in FIG. 4. Each of the wheel assemblies 30,40 includes a pair of fixed wheels of a diameter that is smaller than that of the roller 221 to facilitate turning of the roller board 1 when the roller unit 2 rotates about its axis by virtue of swaying action of the rider's weight to forward, rearward or lateral sides of the platform 10.

One disadvantage encountered during use of the aforesaid conventional roller board 1 resides in that during turning of the roller board 1 by virtue of swaying action of the rider's weight, the second end of the urging spring 24 provides an abrupt change in orientation of the roller unit 2 upon reaching a juncture joined by an adjacent pair of the flat side 237 and the curved side 236. Such a sudden change in orientation of the roller unit 2 results in unstable stance of the rider on the roller board 1, and can cause the rider to fall off the roller board 1 in case the travelling speed of the roller board 1 is relatively high.

SUMMARY OF THE INVENTION

The object of this invention is to provide a roller board provided with a cam mechanism that is adapted to overcome the aforesaid disadvantage associated with the conventional roller board.

Accordingly, a roller board of the present invention includes a base plate, a roller unit, and a cam mechanism. The base plate has a cam retaining bore and an accommodating chamber which surrounds the cam retaining bore. The roller unit includes a caster mounted rotatably to the base plate underneath the cam retaining bore, and a roller journalled to the caster. The cam mechanism includes a cam in the form of a rotatable shaft that is connected to the caster and that extends into the accommodating chamber via the cam retaining bore of the base plate. The cam has a top end which defines an annular cam face with a pair of diametrically opposite lowermost points and a pair of diametrically opposite uppermost points between the lowermost points. A cam follower is disposed within the accommodating chamber of the base plate, and includes an urging spring that has a first end fixed to the base plate and a second end which is disposed above and which abuts against the cam face for urging the cam in an axial direction relative to the cam. The cam is rotatable along with the caster between a first position, in which, the second end of the urging spring abuts against the cam face at one of the lowermost points for urging the caster to be maintained in a travelling direction parallel to a longitudinal axis of the base plate, and a second position, in which, the second end of the urging spring abuts against the cam face at one of the uppermost points for urging the caster to be maintained in a transverse direction relative to the longitudinal axis of the base plate. Rotation of the cam between the first and second positions results in upward and downward movements of the second end of the urging spring in the axial direction.

In use the entire weight of the rider is concentrated on the urging spring, and movement of the second end of the urging spring between the first and second positions incurs a sufficient friction force, which in turn, ensures smooth and stable revolving of the roller unit relative to the base plate during swaying action of the rider for turning the roller board of the present invention.

BRIEF DESCRIPTION OF THE DRAWINGS

These and other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
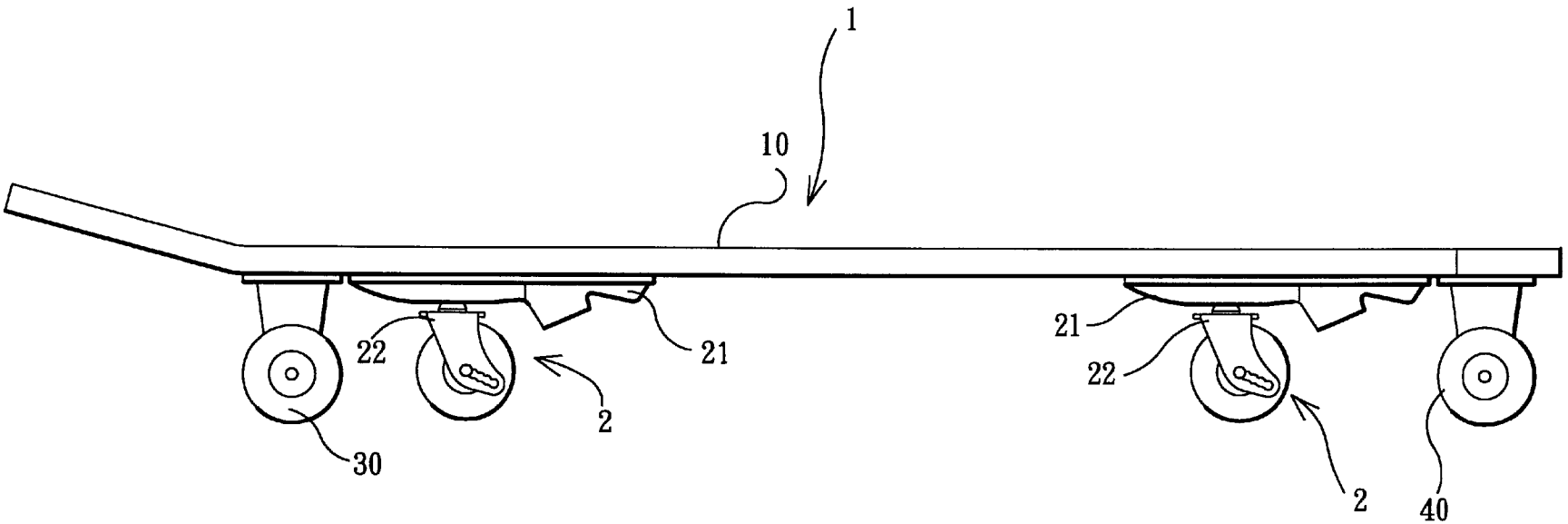
FIG. 1 PRIOR ART
FIG. 1 is a schematic side view of a conventional roller board.
Figure 2:
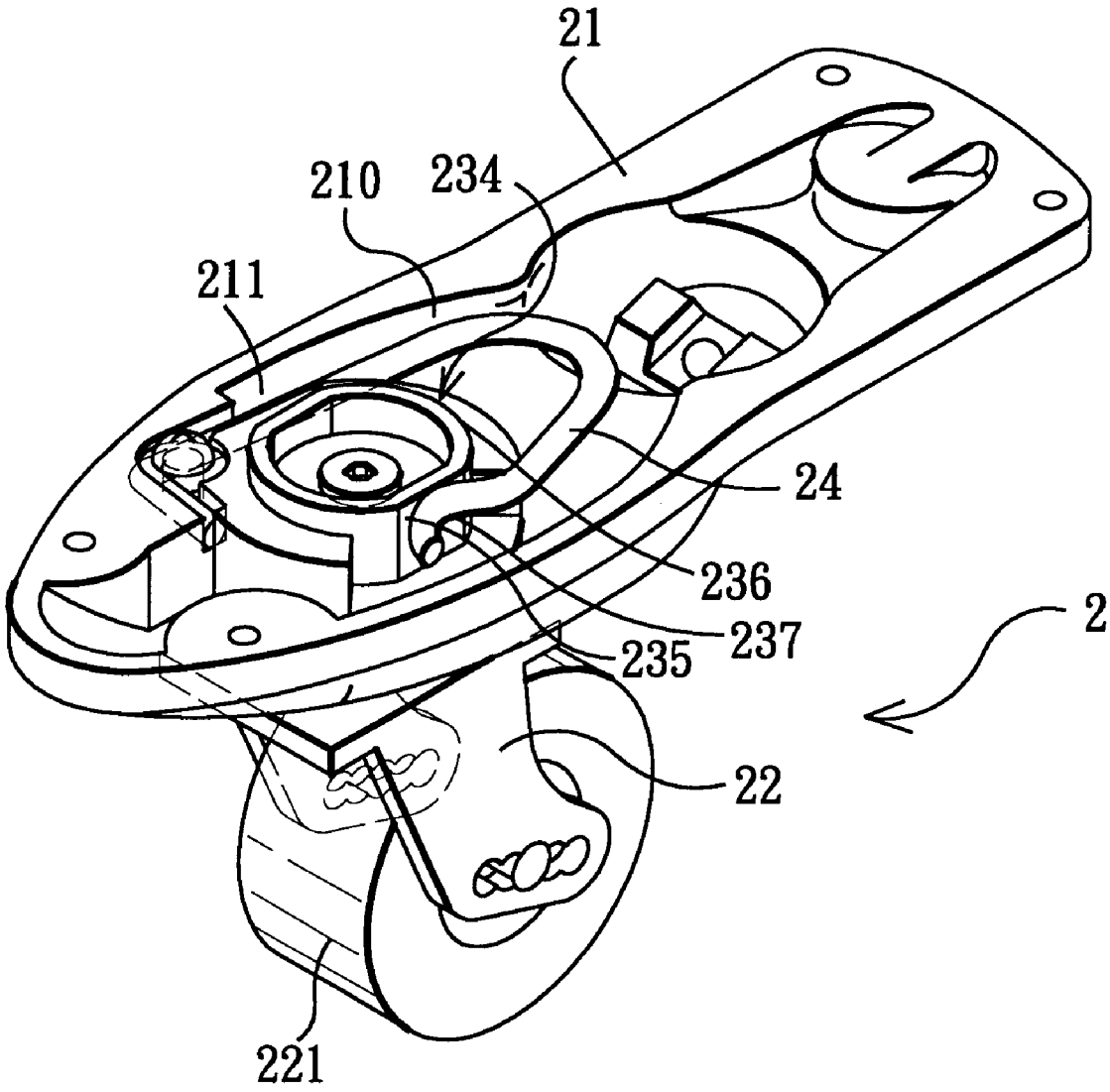
F I G. 2 PRIOR ART
FIG. 2 is a partly view of the conventional roller board, in which a rigid platform is removed from a base plate to illustrate mounting of a roller unit on the base plate.
Figure 3:
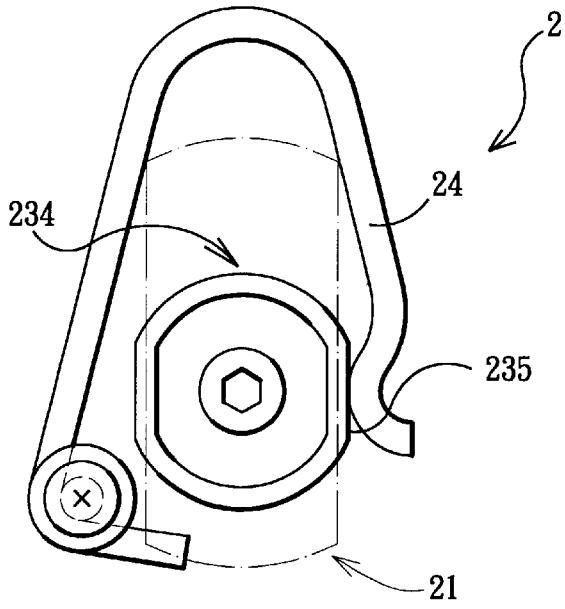
F I G. 3 PRIOR ART
FIG. 3 is a schematic and partly fragmentary top view of the conventional roller board, illustrating how the roller unit is maintained in a travelling direction parallel to a longitudinal axis of the base plate.
Figure 4:
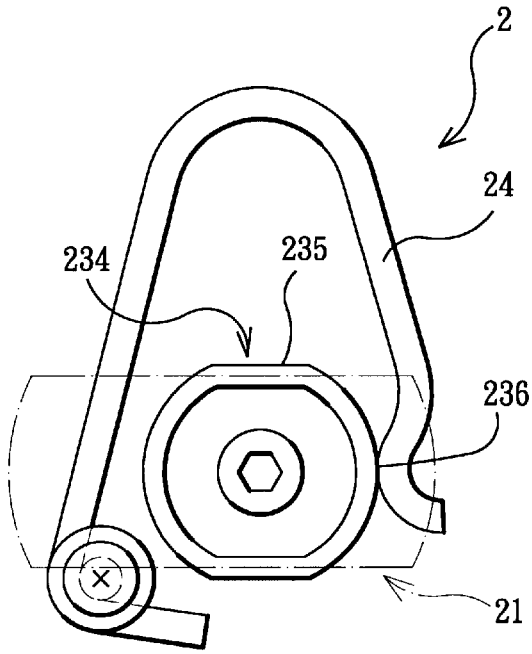
F I G. 4 PRIOR ART
FIG. 4 is a schematic and partly fragmentary top view of the conventional roller board, illustrating how the roller unit is maintained in a transverse direction relative to the longitudinal axis of the base plate.
Figure 5:
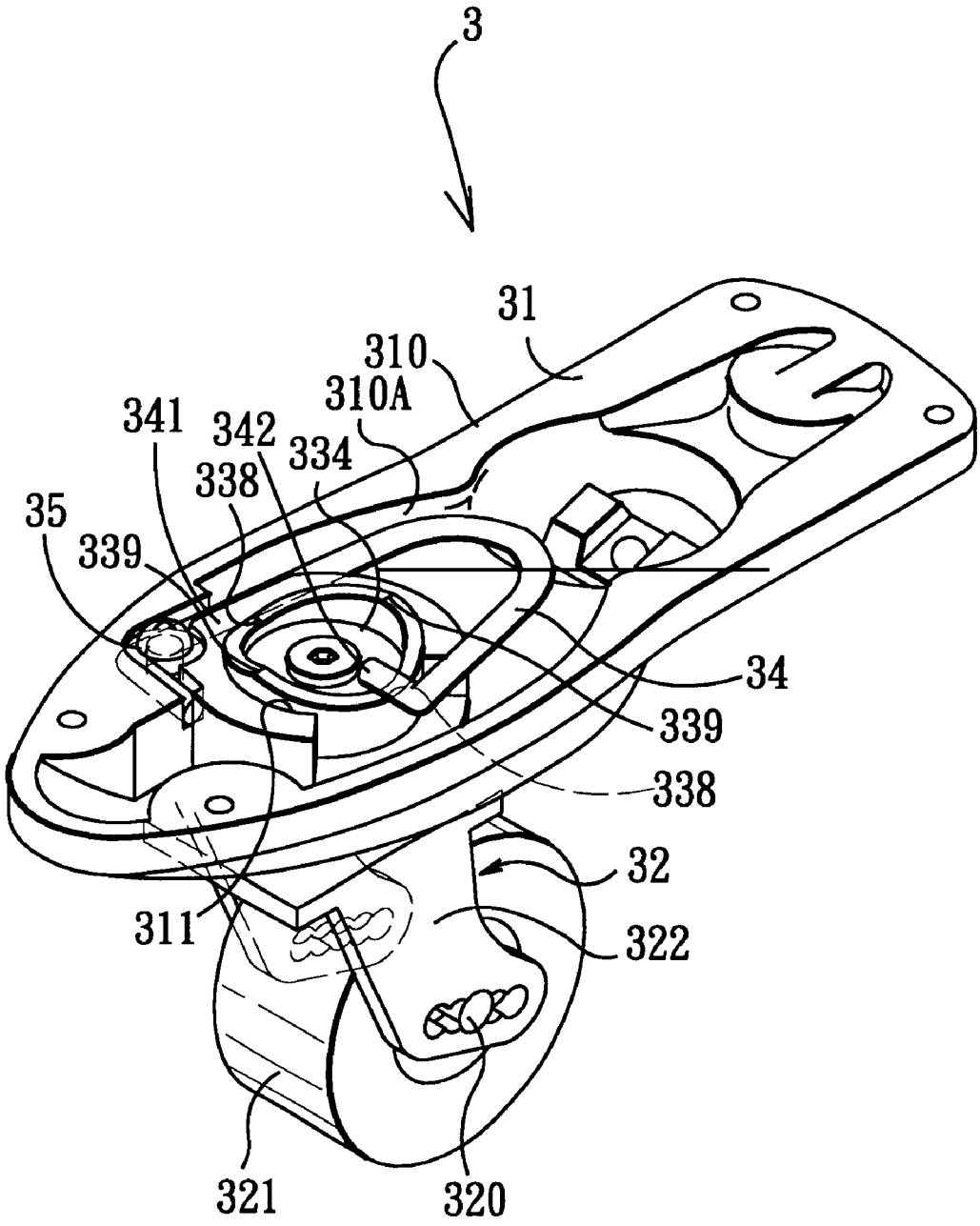
FIG. 5 is a partly view of a preferred embodiment of a roller board according to the present invention, in which a rigid platform is removed from a base plate to illustrate mounting of a roller unit on the base plate.
Figure 6:
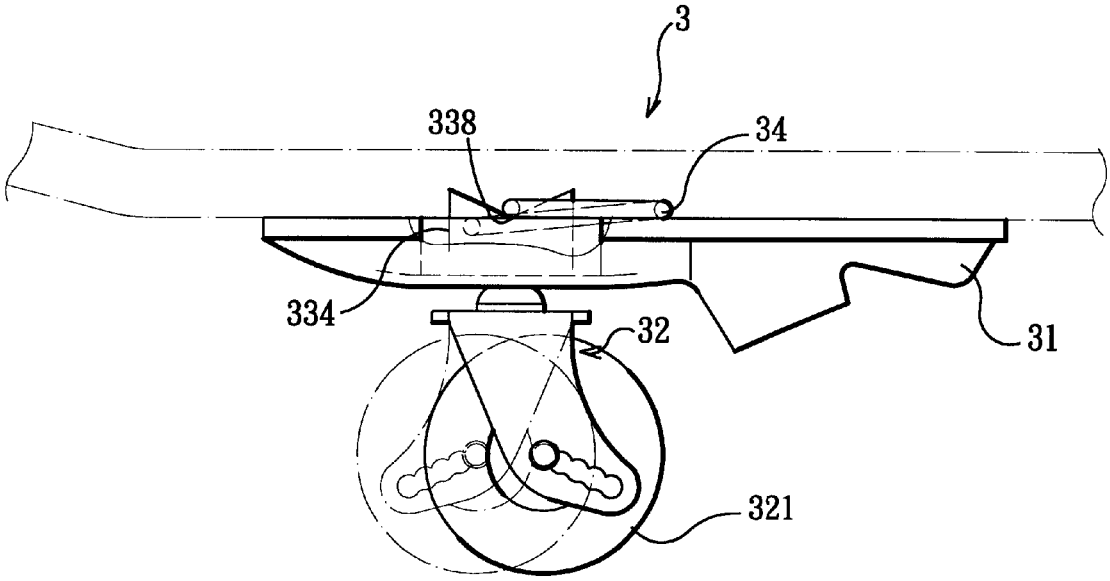
FIG. 6 is a schematic partly fragmentary side view of the preferred embodiment, illustrating how the roller unit is maintained in a travelling direction parallel to a longitudinal axis of the base plate.
Figure 7:
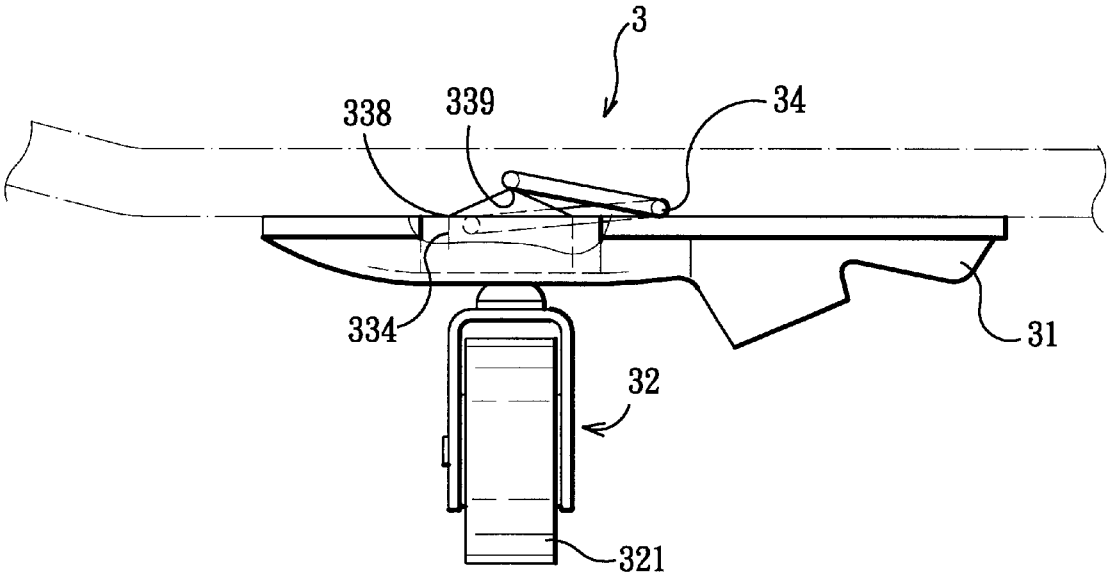
FIG. 7 is a schematic partly fragmentary side view of the preferred embodiment, illustrating how the roller unit is maintained in a transverse direction relative to the longitudinal axis of the base plate.

Referring to FIGS. 5 to 7, the present invention is related to improvements concerning the connecting relationship between the base plate 31 and the roller unit 32 of a roller board 3 similar to the aforesaid conventional roller board.

As illustrated, the base plate 31 has a cam retaining bore 311 and an accommodating chamber (310A) which is formed in a top surface thereof and which surrounds the cam retaining bore 311.

The roller unit 32 includes a caster 322 mounted rotatably to the base plate 31 underneath the cam retaining bore 311, and a roller 321 journalled to the caster 322.

A cam mechanism includes a cam and a cam follower. The cam, in the form of a rotatable shaft 334, is connected to the caster 32 and extends into the accommodating chamber (310A) via the cam retaining bore 311 of the base plate 31. The shaft 334 has a top end which defines an annular cam face with a pair of diametrically opposite lowermost points 338 and a pair of diametrically-opposite uppermost points 339 between the lowermost points 338. The cam follower is disposed within the accommodating chamber (310A) of the base plate 31, and includes an urging spring 34 that has a first end 341 fixed to the base plate 31, and a second end 342 which is disposed above and which abuts against the cam face for urging the shaft 334 in an axial direction relative to the shaft 334. The shaft 334 is rotatable along with the caster 32 by virtue of swaying action of the rider between a first position, in which the second end 342 of the urging spring 34 abuts against the cam face at one of the lowermost points 338 for urging the caster 32 to be maintained in a travelling direction parallel to a longitudinal axis of the base plate 31 (see FIG. 6), and a second position, in which the second end 342 of the urging spring 34 abuts against the cam face at one of the uppermost points 339 for urging the caster 32 to be maintained in a transverse direction relative to the longitudinal axis of the base plate (see FIG. 7). Rotation of the shaft 334 between the first and second positions results in upward and downward movements of the second end 342 of the urging spring 34 in the axial direction. Preferably, the shaft 334 is constructed to be hollow to minimize the material requirement thereof and to provide a relatively large cam face, and has a flat bottom connected securely to the caster 32 in a known manner.

In use, the entire weight of the rider is concentrated on the urging spring 34, and movement of the second end 342 of the urging spring 34 between the first and second positions incurs a sufficient friction force, which in turn, ensures smooth and stable revolving of the roller unit 32 relative to the base plate 31 during swaying action of the rider for turning the roller board 3 of the present invention.

With this invention thus explained, it is apparent that numerous modifications and variations can be made without departing from the scope and spirit of this invention. It is therefore intended that this invention be limited only as indicated by the appended claims.

I claim:

1. A roller board comprising:

a base plate having a cam retaining bore and an accommodating chamber surrounding said cam retaining bore;

a roller unit including a caster mounted rotatably to said base plate underneath said cam retaining bore, and a roller journalled to said caster; and a cam mechanism including a cam in the form of a rotatable shaft that is connected to said caster and that extends into said accommodating chamber via said cam retaining bore in said base plate, said cam having a top end which defines an annular cam face with a pair of diametrically opposite lowermost points and a pair of diametrically opposite uppermost points between said lowermost points, and a cam follower disposed within said accommodating chamber and including an urging spring that has a first end fixed to said base plate and a second end disposed above and abutting against said cam face for urging said cam in an axial direction relative to said cam, said cam being rotatable along with said caster between a first position, in which said second end of said urging spring abuts against said cam face at one of said lowermost points for urging said caster to be maintained in a travelling direction parallel to a longitudinal axis of said base plate, and a second position, in which said second end of said urging spring abuts against said cam face at one of said uppermost points for urging said caster to be maintained in a transverse direction relative to said longitudinal axis of said base plate, rotation of said cam between said first and second positions resulting in upward and downward movements of said second end of said urging spring in said axial direction.

2. The roller board as defined in claim 1, wherein said cam is hollow, and has a flat bottom connected securely to said caster.

* * * * *